US011597545B2

(12) United States Patent
Ni

(10) Patent No.: US 11,597,545 B2
(45) Date of Patent: Mar. 7, 2023

(54) CABLE TIE TOOL

(71) Applicant: HUA WEI INDUSTRIAL CO., LTD., Taichung (TW)

(72) Inventor: Tony Ni, Taichung (TW)

(73) Assignee: HUA WEI INDUSTRIAL CO., LTD., Taichung (TW)

( * ) Notice: Subject to any disclaimer, the term of this patent is extended or adjusted under 35 U.S.C. 154(b) by 266 days.

(21) Appl. No.: 17/169,395

(22) Filed: Feb. 5, 2021

(65) Prior Publication Data

US 2022/0250777 A1 Aug. 11, 2022

(51) Int. Cl.

| | |
|---|---|
| ***B65B 13/02*** | (2006.01) |
| ***B25B 25/00*** | (2006.01) |
| ***B26D 1/08*** | (2006.01) |
| ***B26D 7/27*** | (2006.01) |

(52) U.S. Cl.

CPC ..... *B65B 13/027* (2013.01); *B26D 1/085* (2013.01); *B26D 7/27* (2013.01); *B25B 25/00* (2013.01)

(58) Field of Classification Search

CPC ... B65B 13/027; B65B 13/025; B65B 13/305; B65B 13/345; B25B 25/00; B25B 27/146

USPC ..... 140/93 A

See application file for complete search history.

(56) References Cited

U.S. PATENT DOCUMENTS 3,735,784 A * 5/1973 Obuch ..... B21F 9/02 140/93.2

4,733,701 A * 3/1988 Loisel ..... B65B 13/027 D8/52

5,372,166 A * 12/1994 Lai ..... B65B 13/027 140/93.2

* cited by examiner

*Primary Examiner* — Shelley M Self
*Assistant Examiner* — Bobby Yeonjin Kim
(74) *Attorney, Agent, or Firm* — Hershkovitz & Associates, PLLC; Abe Hershkovitz

(57) ABSTRACT

A cable tie tool has a first operating unit, a second operating unit, a pivoting shaft, a torsion spring, a cutting assembly, and an extension spring. The second operating unit has two guiding holes aligned to each other. The pivoting shaft is mounted in the guiding holes, is pivotally connected the first and the second operating units, and is movable along the guiding holes. The torsion spring abuts against and pushes the first and the second operating units. The cutting assembly has an activating element pivotally connected to the second operating unit and a cutting element movably mounted in the second operating unit and driven by the activating element. The extension spring is connected between the activating element and the second operating unit. When the extension spring is stretched, the activating element blocks the pivoting shaft from moving along the guiding holes.

5 Claims, 10 Drawing Sheets

CABLE TIE TOOL

BACKGROUND OF THE INVENTION

1. Field of the Invention

The present invention relates to a tool for tensioning cable ties, and more particularly to a cable tie tool that is able to tighten a cable tie and cut extra tail of the cable tie at the same time.

2. Description of Related Art

Cable ties are usually applied to wrap objects such as cables or elongated sticks. In order to ensure a cable tie is tightly wrapped around the objects, cable tie guns or cable tie cutting tools are used to tighten the cable tie.

With reference to FIG. 10, a conventional cable tie tool has a first handle 100A, a second handle 100B, and a third handle 100C. The first handle 100A and the second handle 100B are pivotally connected with each other. The first handle 100A is provided with a stopping element for clamping a cable tie. The second handle 100B is provided with a cutting element 100D for cutting the cable tie. The third handle 100C is pivotally connected to the first handle 100A and connected to the cutting element 100D.

When the conventional cable tie tool is used to tighten the cable tie, a terminal end of the cable tie is inserted through a head of the cable tie, and then the cable tie is inserted through the first handle 100A and the second handle 100B. When a user manipulates the first handle 100A and the second handle 100B, the cable tie is clamped by the stopping element of the first handle 100A, and the head of the cable tie is pushed by the second handle 100B. Therefore, the cable tie is tightened to firmly wrap around the objects. Finally, the user presses the third handle 100C to push out the cutting element 100D to cut the cable tie.

However, in the conventional cable tie tool, the third handle 100C is needed to control the cutting element 100D, such that a structure of the conventional cable tie tool is complicated. The user has to manipulate the third handle 100C to cut the cable tie, which is inconvenient.

To overcome the shortcomings of the conventional cable tie tool, the present invention provides a cable tie tool to mitigate or obviate the aforementioned problems.

SUMMARY OF THE INVENTION

The main objective of the present invention is to provide a cable tie tool that is convenient for use.

The cable tie tool has a first operating unit, a second operating unit, a pivoting shaft, a torsion spring, a cutting assembly, and an extension spring. The second operating unit has two guiding holes aligned to each other. The pivoting shaft is mounted within the guiding holes, pivotally connected with the first and the second operating units, and being movable along the guiding holes. The torsion spring abuts against and pushes the first and the second operating units. The cutting assembly has an activating element pivotally connected to the second operating unit and a cutting element movably mounted in the second operating unit and driven by the activating element. The extension spring is connected between the activating element and the second operating unit. The extension spring is stretched such that the activating element blocks the pivoting shaft from moving along the guiding holes.

Other objects, advantages, and novel features of the invention will become more apparent from the following detailed description when taken in conjunction with the accompanying drawings.

DETAILED DESCRIPTION OF PREFERRED EMBODIMENTS

Figure 1:
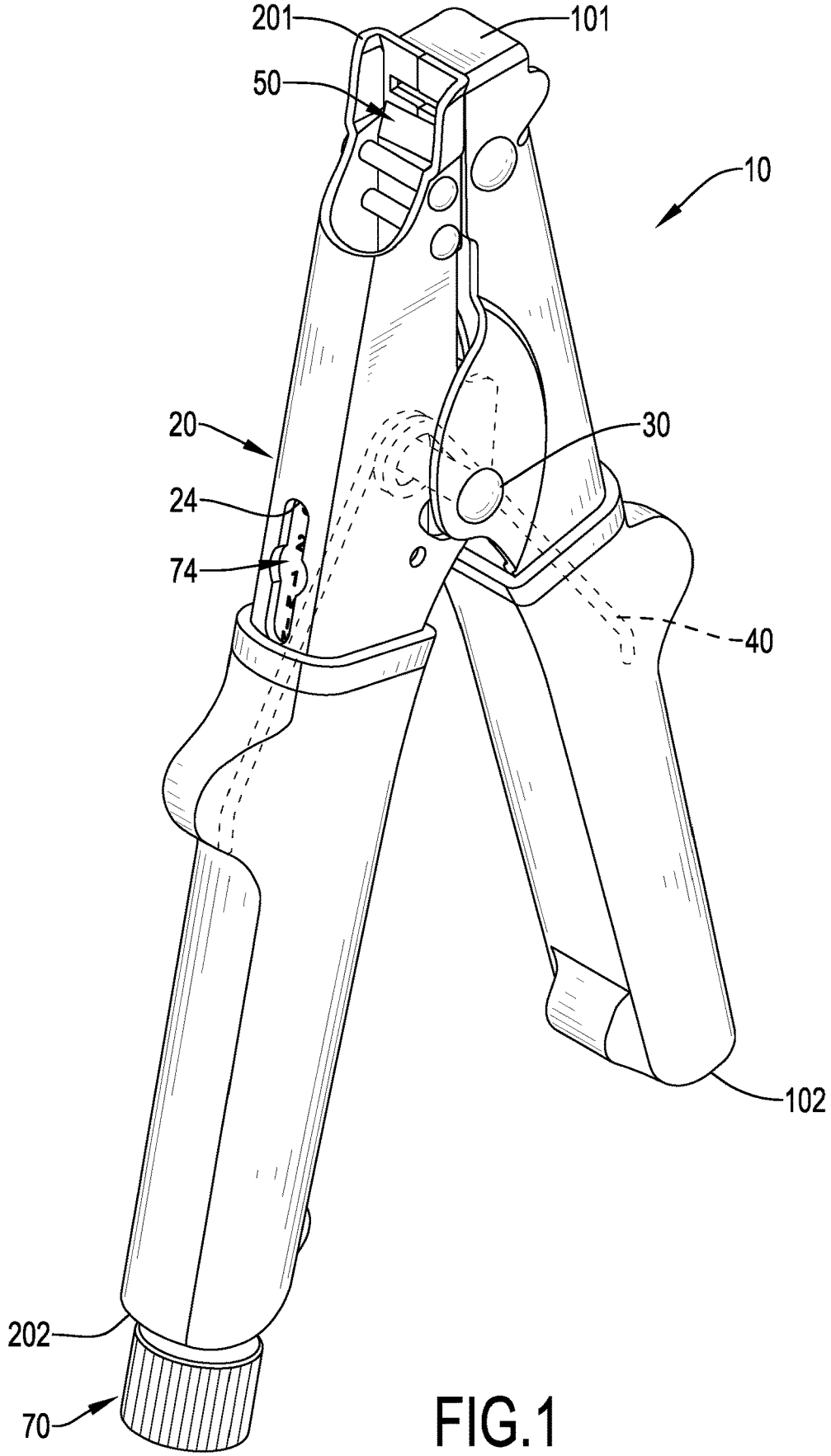
FIG. 1 is a perspective view of a cable tie tool in accordance with the present invention.
Figure 2:
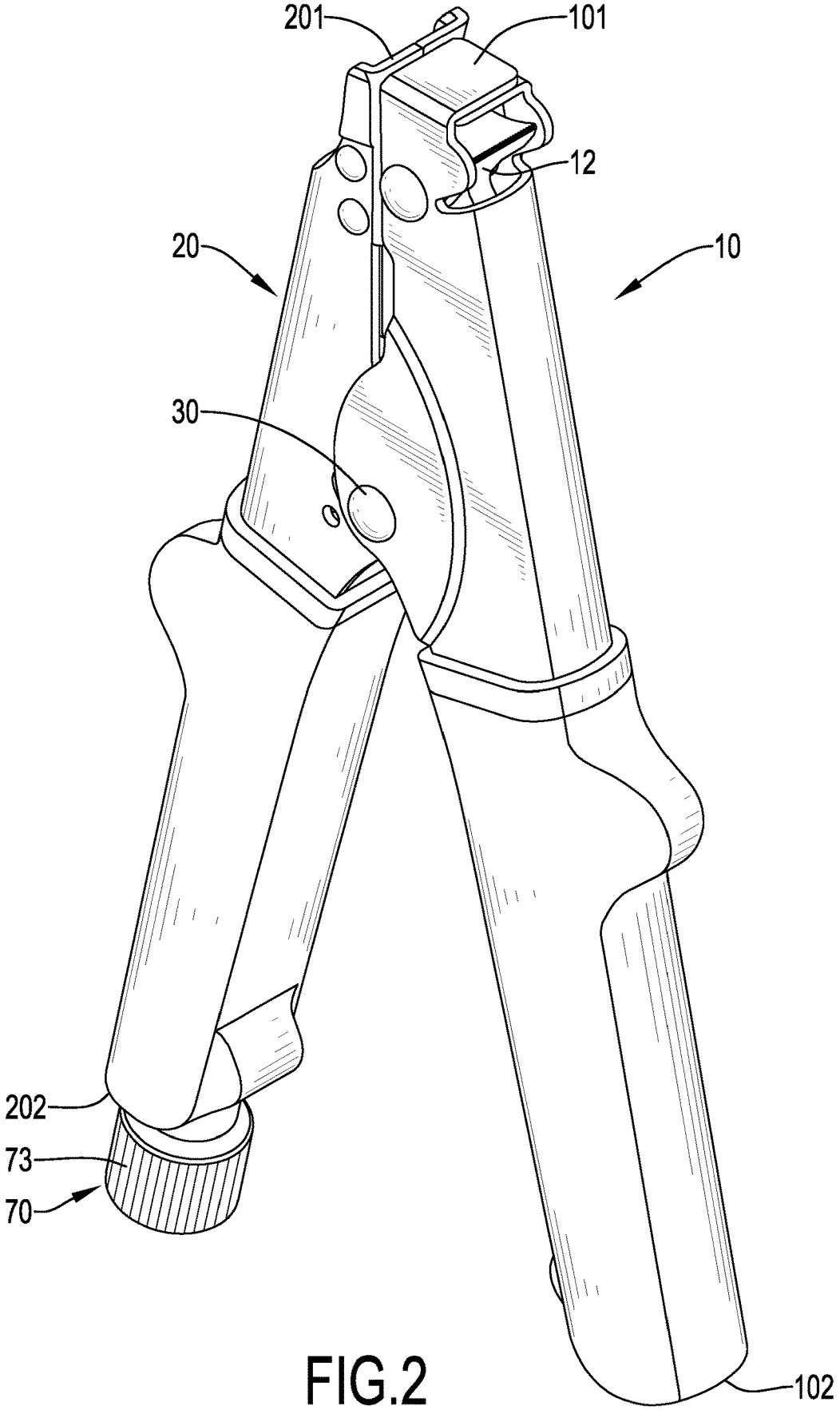
FIG. 2 is another perspective view of the cable tie tool in FIG. 1.
Figure 3:
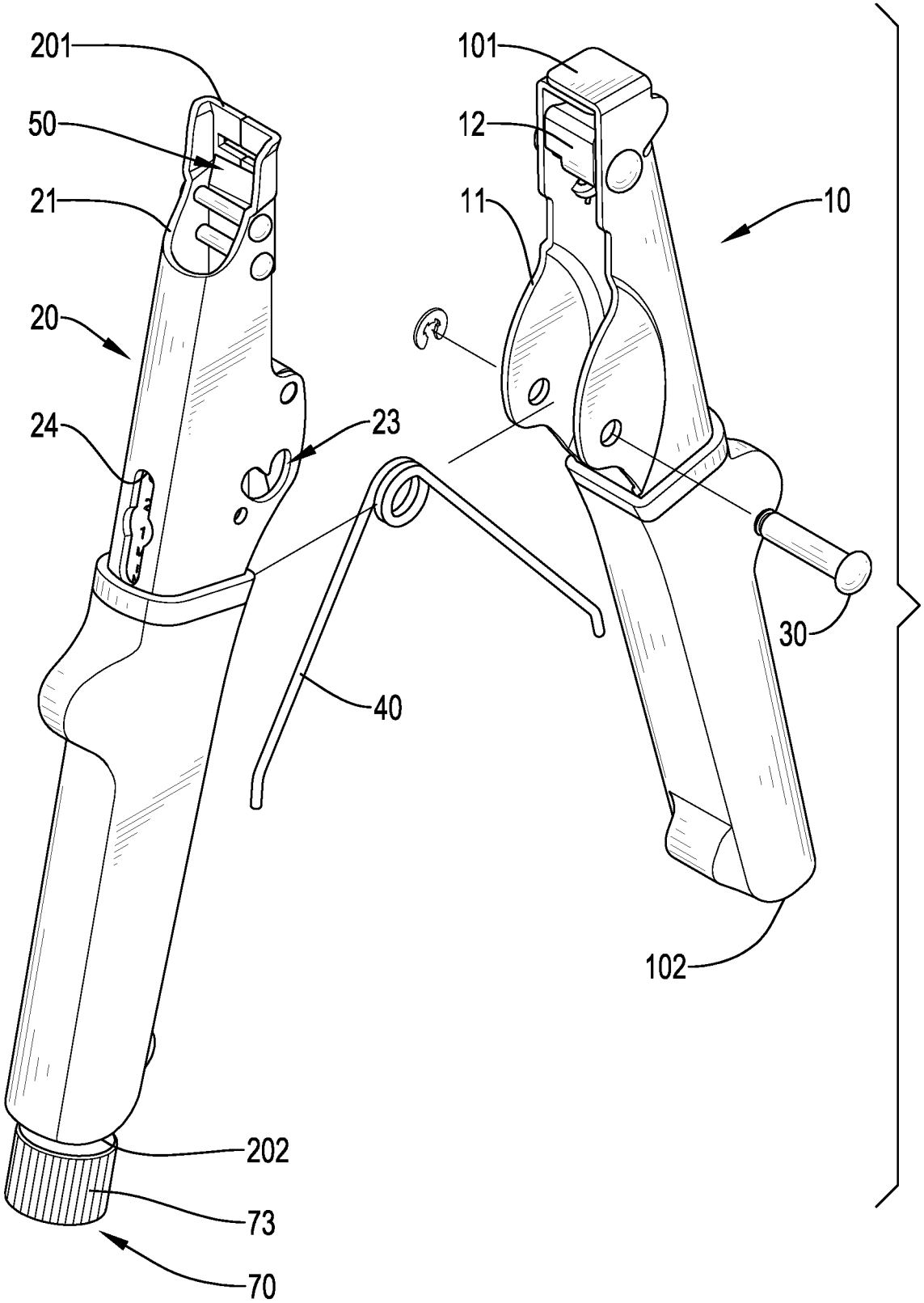
FIG. 3 is an exploded perspective view of the cable tie tool in FIG. 1.

With reference to FIGS. 1 to 3, a cable tie tool in accordance with the present invention has a first operating unit 10, a second operating unit 20, a pivoting shaft 30, a torsion spring 40, a cutting assembly 50, an extension spring 60, and an adjusting assembly 70.

With reference to FIGS. 1 to 3, and 6, the first operating unit 10 has a clamping end 101 and an operating end 102 disposed opposite to each other and has a first main body 11 and a clamping element 12. The clamping element 12 is a block pivotally connected to the first main body 11 and is disposed adjacent to the clamping end 101 of the first operating unit 10.

With reference to FIGS. 1 to 5A and 5B, the second operating unit 20 has a cutting end 201 and an adjusting end 202 disposed opposite to each other and has a second main body 21, a through hole 22, two guiding holes 23, an observing hole 24, two restricting elements 25, a first blocking plate 26, and a second blocking plate 27. The through hole 22 is defined through the second main body 21.

The two guiding holes 23 are defined through the second main body 21 and are aligned with each other. Each guiding hole 23 is curved and has a first guiding section 231, a curved section 232, and a second guiding section 233 sequentially arranged and communicating with one another. The first guiding section 231 of each guiding hole 23 has a first terminal end positioned toward the cutting end 201 of the second operating unit 20. The first guiding section 231 extends toward the adjusting end 202 of the second operating unit 20 and has a length L1. The curved section 232 of each guiding hole 23 extends toward the cutting end 201 of the second operating unit 20. The second guiding section 233 of each guiding hole 23 has a second terminal end positioned toward the cutting end 201 of the second operating unit 20 and has a length L2 being shorter than the length L1 of the first guiding section 231 of the guiding hole 23.

With reference to FIGS. 1 to 5A and 5B, the observing hole 24 is defined through the second main body 21. The observing hole 24 is elongated and extends toward the cutting end 201 and the adjusting end 202 of the second operating unit 20. Each restricting element 25 is a stick. The two restricting elements 25 are parallel to each other, are mounted to the second main body 12, and are disposed adjacent to the cutting end 201 of the second operating unit 20. The first blocking plate 26 and the second blocking plate 27 are disposed separately, are connected to the second main body 21, and are disposed adjacent to the adjusting end 202 of the second operating unit 20.

With reference to FIGS. 1 to 3, the pivoting shaft 30 is mounted within the two guiding holes 23 of the second operating unit 20 and the first main body 11 of the first operating unit 10 to pivotally connect the first operating unit 10 and the second operating unit 20. The pivoting shaft 30 is parallel to the two restricting elements 25 and is able to move along the two guiding holes 23.

With reference to FIGS. 3 to 6, the torsion spring 40 has two ends. The two ends of the torsion spring 40 respectively abut against and respectively push the first main body 11 of the first operating unit 10 and the second main body 21 of the second operating unit 20 such that the clamping end 101 of the first operating unit 10 abut against the cutting end 201 of the second operating unit 20.

Figure 4:
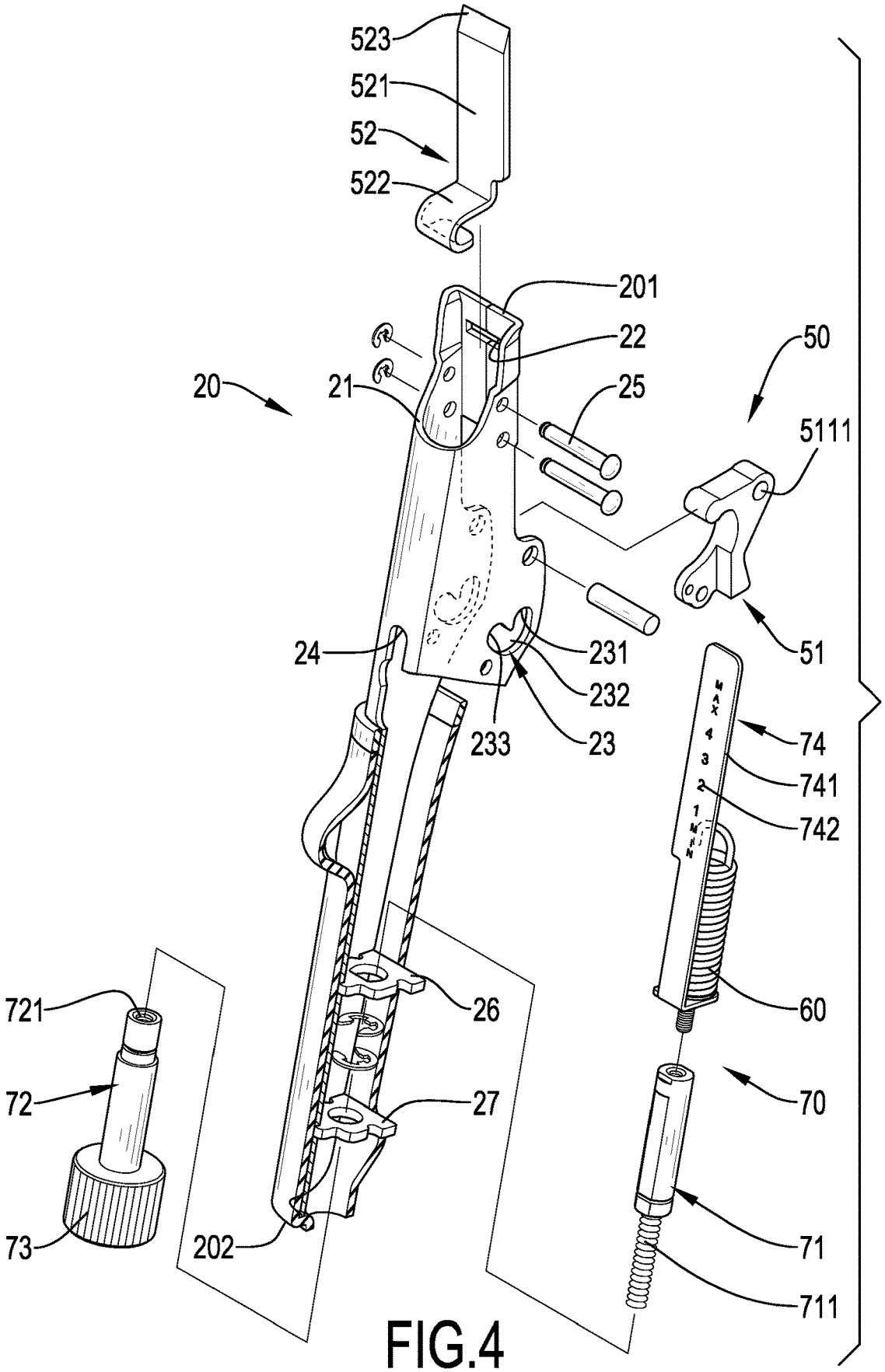
FIG. 4 is a detailed exploded perspective view of a second operating unit of the cable tie tool in FIG. 1.
Figure 5A:
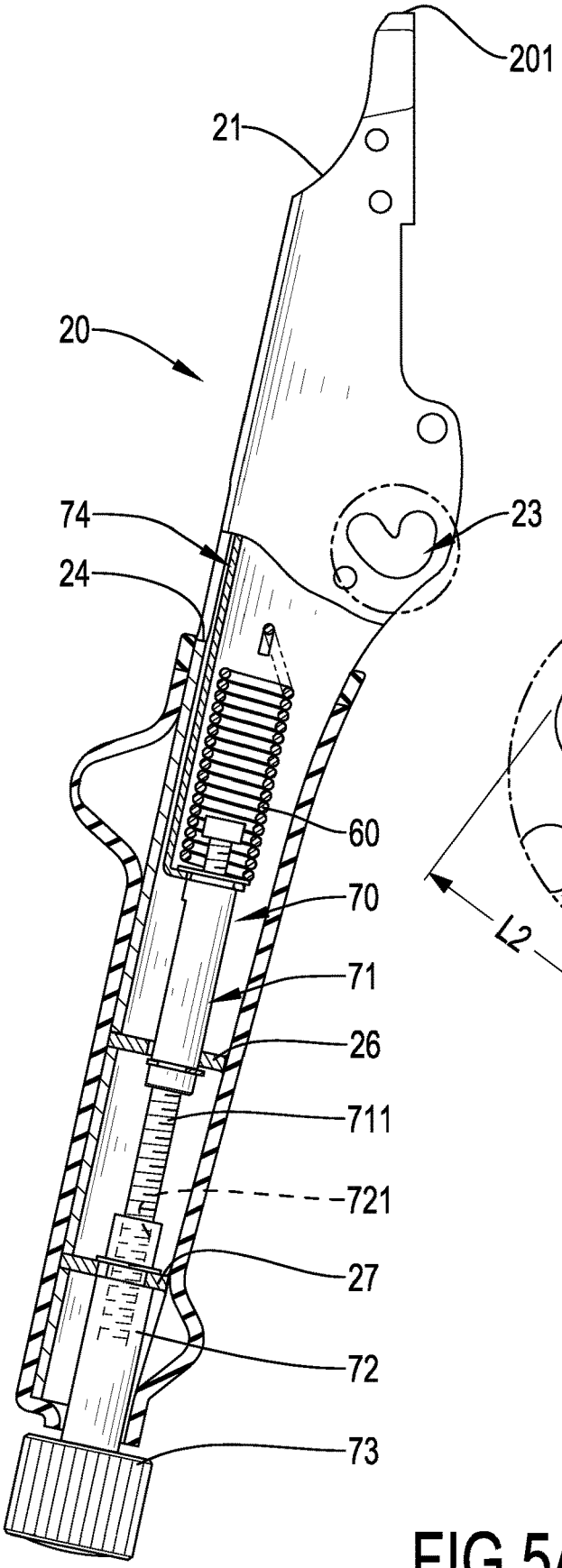
FIG. 5A is a side view in partial section of the second operating unit of the cable tie tool in FIG. 1.
Figure 5B:
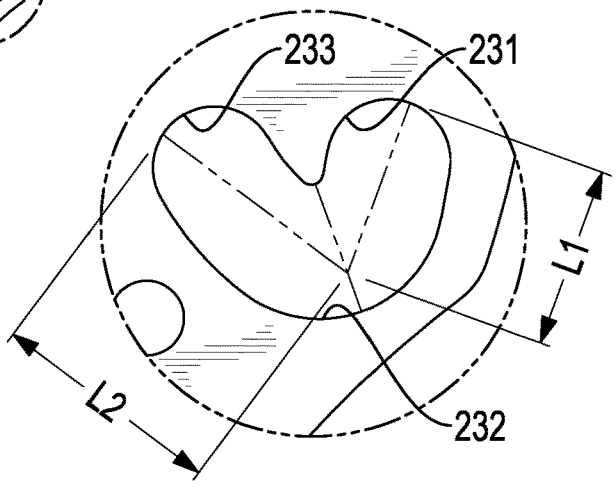
FIG. 5B is an enlarged side view of a second main body of the second operating unit in FIG. 5A.
Figure 6:
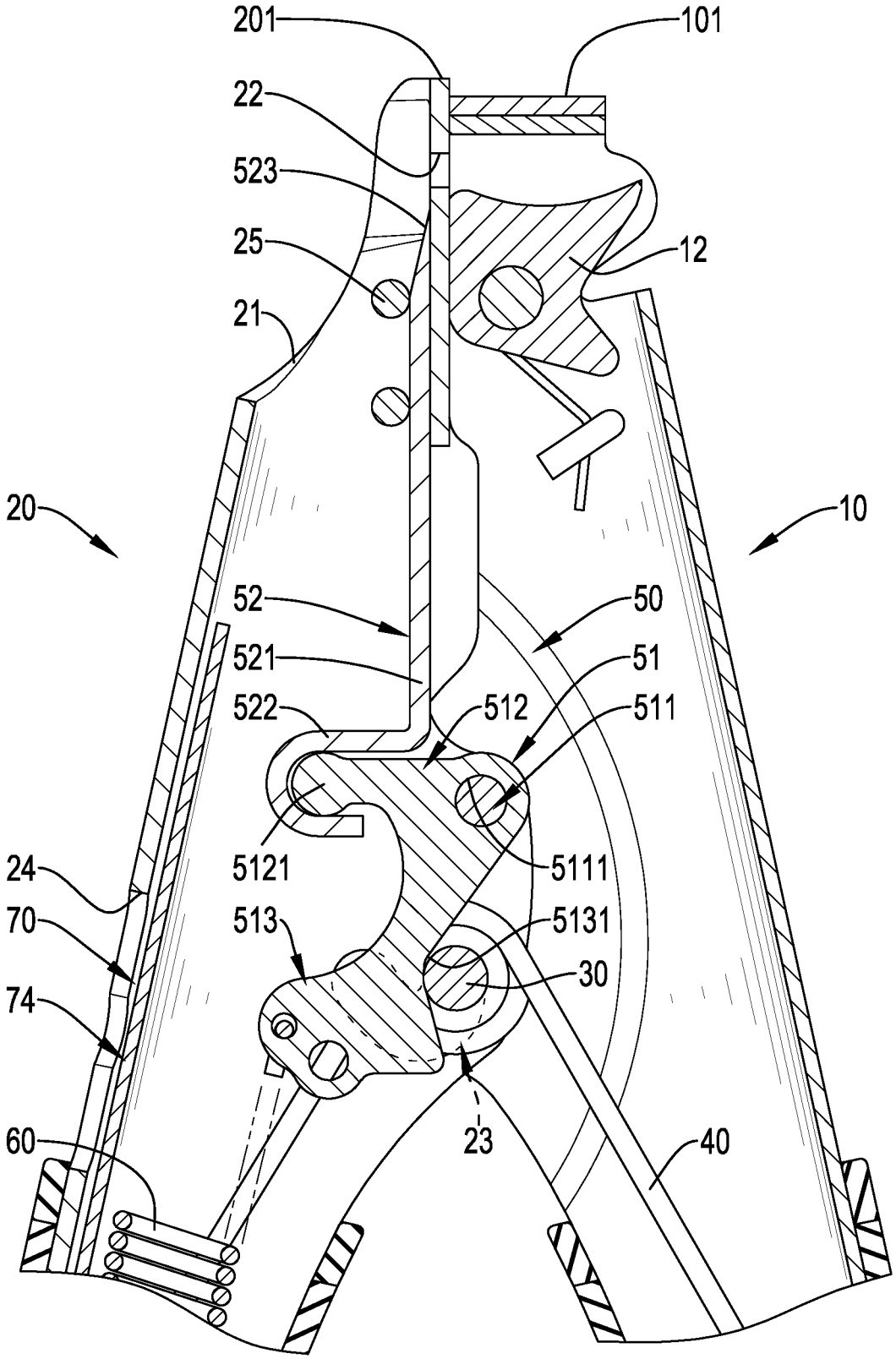
FIG. 6 is an enlarged cross-sectional side view of the cable tie tool in FIG. 1.

With reference to FIGS. 1, 4, and 6, the cutting assembly 50 has an activating element 51 and a cutting element 52. The activating element 51 has a pivoting portion 511, an activating arm 512, and a blocking arm 513. The pivoting portion 511 has a pivoting hole 5111 for mounting a pin. The activating arm 512 is pivotally connected to the second main body 21 of the second operating unit 20 via the pin accordingly. The activating element 51 is pivotally connected to the second operating unit 20 and abuts against the pivoting shaft 30. Both the activating arm 512 and the blocking arm 513 extend from the pivoting portion 511. The activating arm 512 has an engaging protrusion 5121 disposed at a terminal end of the activating arm 512. The blocking arm 513 has a recess 5131 for receiving the pivoting shaft 30.

The cutting element 52 has a blade 521, an engaging hook 522, and a cutting edge 523. The blade 521 is disposed between the two restricting elements 25 and the second main body 21 and is restricted by the two restricting elements 25. Therefore, the blade 521 is movably mounted in the second operating unit 20 and is able to move toward the cutting end 201 and the adjusting end 202 of the second operating unit 20. The blade 521 has two opposite ends. The engaging hook 522 is disposed at one of the two opposite ends of the blade 521 and hooks on the engaging protrusion 5121 of the activating arm 512. The blade 523 is disposed at the other one of the two opposite ends of the cutting blade 521 and is positioned toward the cutting end 201 of the second operating unit 20.

With reference to FIGS. 4 and 6, the extension spring 60 has a first end and a second end. The first end of the extension spring 60 is mounted and connected to the blocking arm 513 of the activating arm 51. The second end of the extension spring 60 extends toward the adjusting end 202 of the second operating unit 20 and is connected to the adjusting end 202. The extension spring 60 is stretched such that the recess 5131 of the blocking arm 513 abuts against the pivoting shaft 30 and the activating element 51 blocks the pivoting shaft 30 from moving along the two guiding holes 23.

With reference to FIGS. 1 and 4, the adjusting assembly 70 has a first adjusting element 71, a second adjusting element 72, a knob 73, and an indicating element 74. The first adjusting element 71 is fixed to the second end of the extension spring 60 and has a threaded portion 711. The first adjusting element 71 is blocked by the first blocking plate 26 such that the extension spring 60 is stretched. The second adjusting element 72 is stick-shaped and has a threaded hole 721. The threaded hole 721 is threaded with the threaded portion 711 of the first adjusting element 71. And the second adjusting element 72 is blocked by the second blocking plate 27 to prevent the second adjusting element 72 from detaching from the second operating unit 20. The knob 73 is fixed to the second adjusting element 72, abuts against the adjusting end 202, and is able to be rotated together with the second adjusting element 72. The indicating element 74 is connected between the second end of the extension spring 60 and the first adjusting element 71. The indicating element 74 has an indicating plate 741 and multiple indicating marks 742 disposed on the indicating plate 741. The indicating plate 741 covers the observing hole 24 of the second operating unit 20 and the indicating marks 742 are exposed in the observing hole 24.

With reference to FIG. 6, the stretched extension spring 60 subjects force to the blocking arm 513. Therefore, the recess 5131 of the blocking arm 513 abuts against the pivoting shaft 30, retains the pivoting shaft 30 in the first guiding sections 231 of the two guiding holes 23, and prevents the pivoting shaft 30 from moving along the two guiding holes 23.

Figure 7:
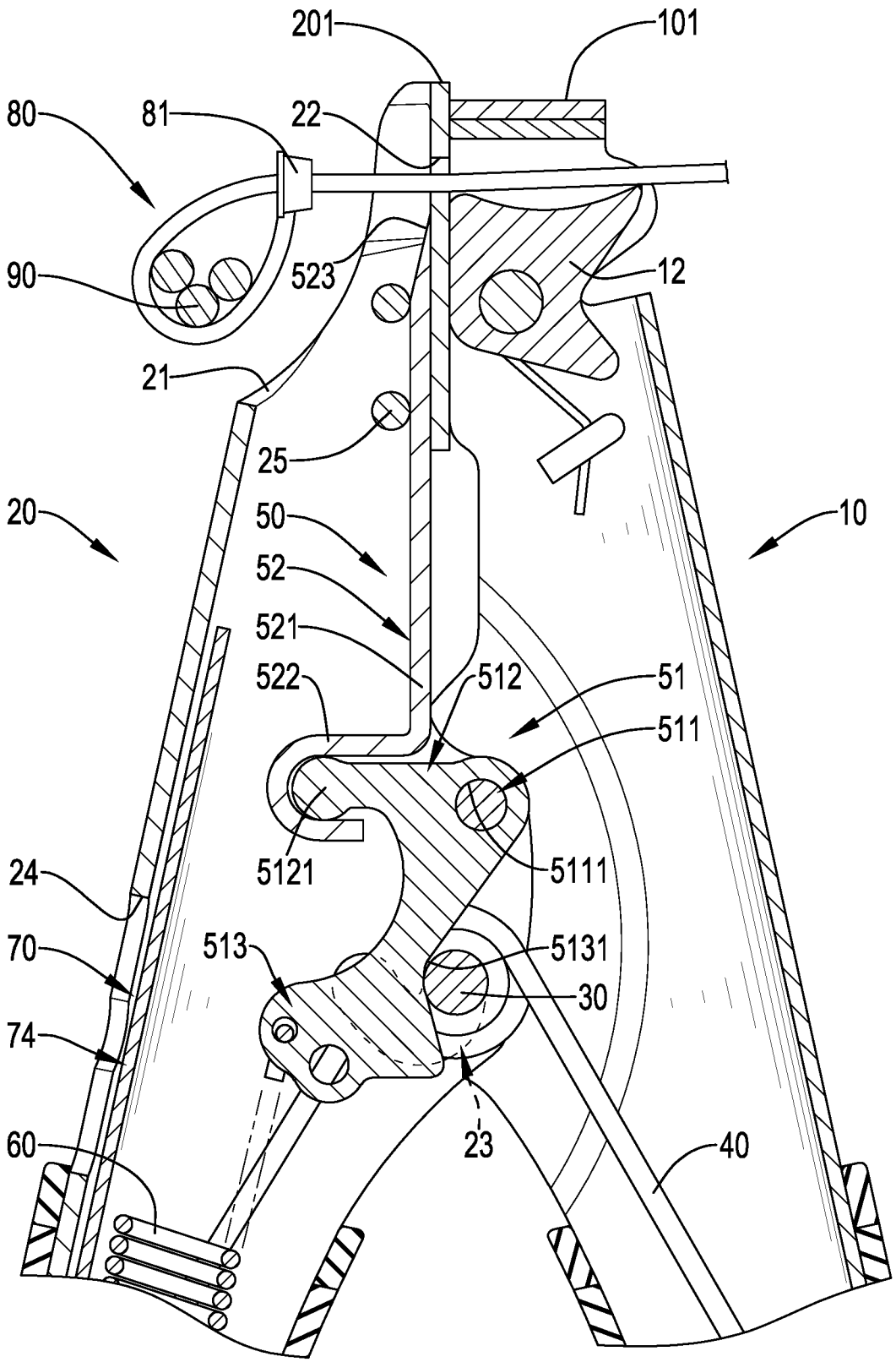
FIG. 7 is a first enlarged operational cross-sectional side view of the cable tie tool in FIG. 1.
Figure 8:
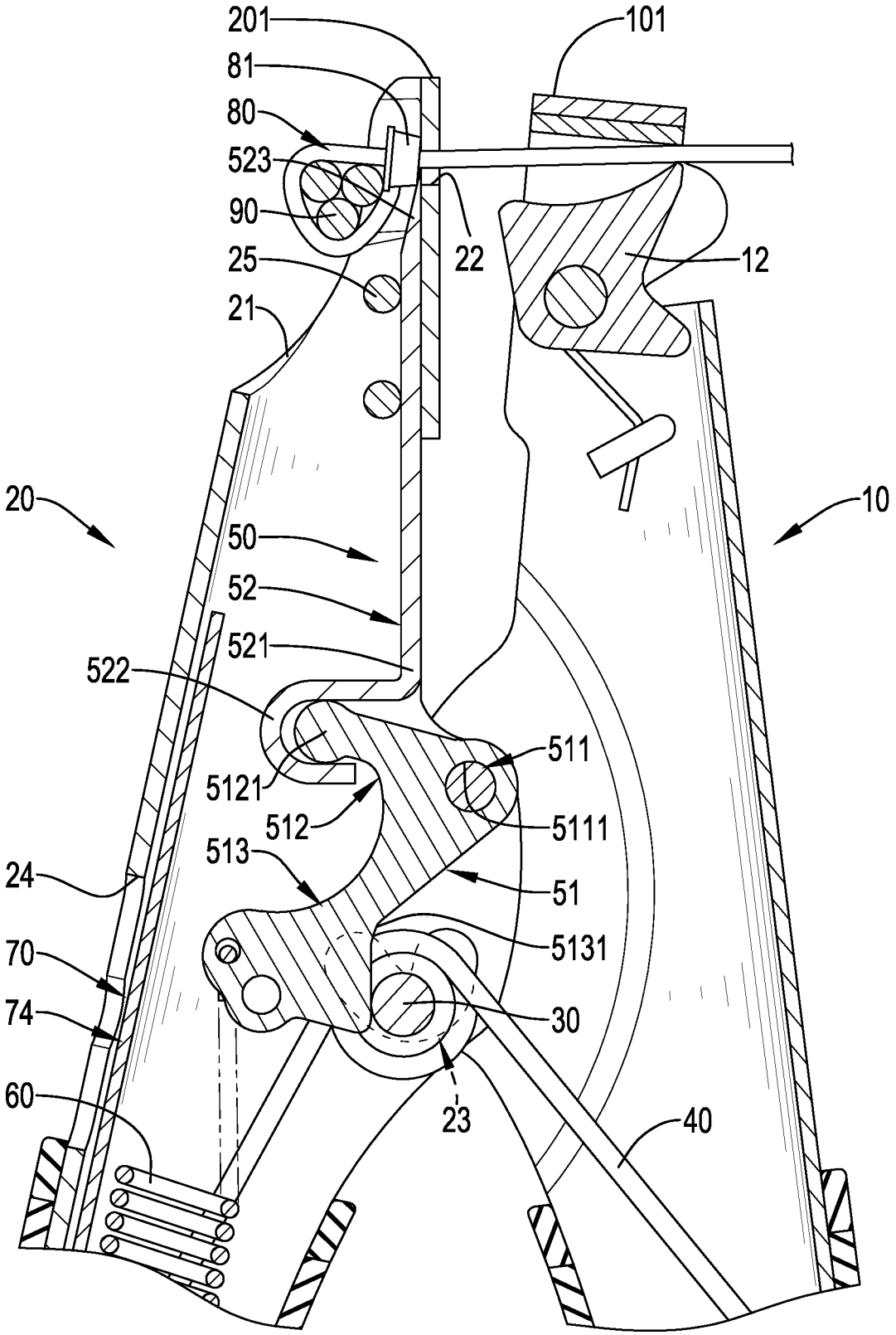
FIG. 8 is a second enlarged operational cross-sectional side view of the cable tie tool in FIG. 1.

With reference to FIGS. 7 and 8, a cable tie 80 is wrapped around multiple objects 90 and has a head 81. The cable tie 80 is inserted within the through hole 22 of the second operating unit 20 and is disposed between the first main body 11 and the clamping element 12 of the first operating unit 10. When a user presses the operating end 102 of the first operating unit 10 and the adjusting end 202 of the second operating element 20, the first main body 11 and the clamping element 12 clamp the cable tie 80 together, and the cutting end 201 of the second operating unit 20 pushes the head 81 of the cable tie 80 toward the multiple objects 90 such that the cable tie 80 tightens the multiple objects 90.

Figure 9:
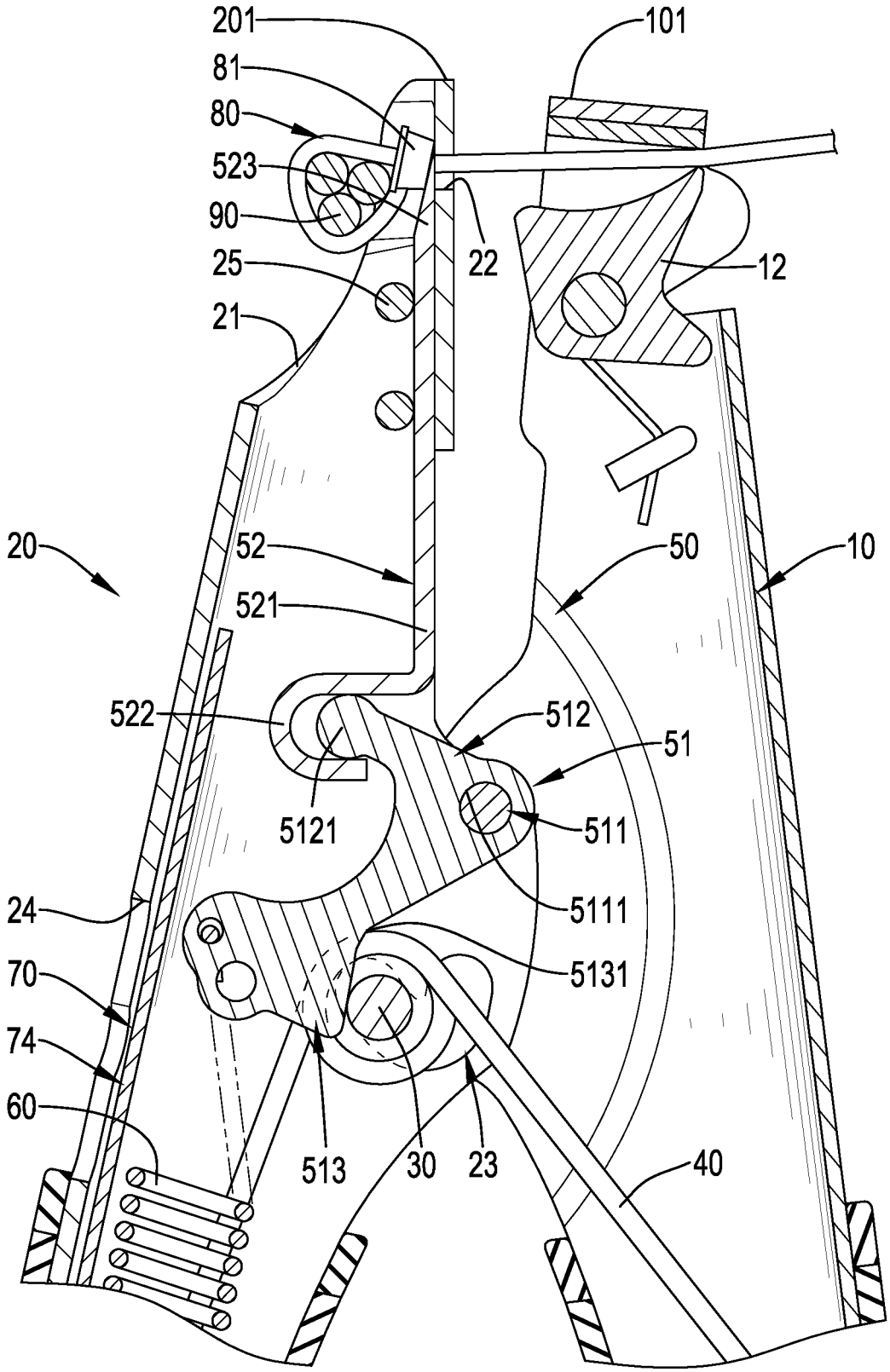
FIG. 9 is a third enlarged operational cross-sectional side view of the cable tie tool in FIG. 1.
Figure 10:
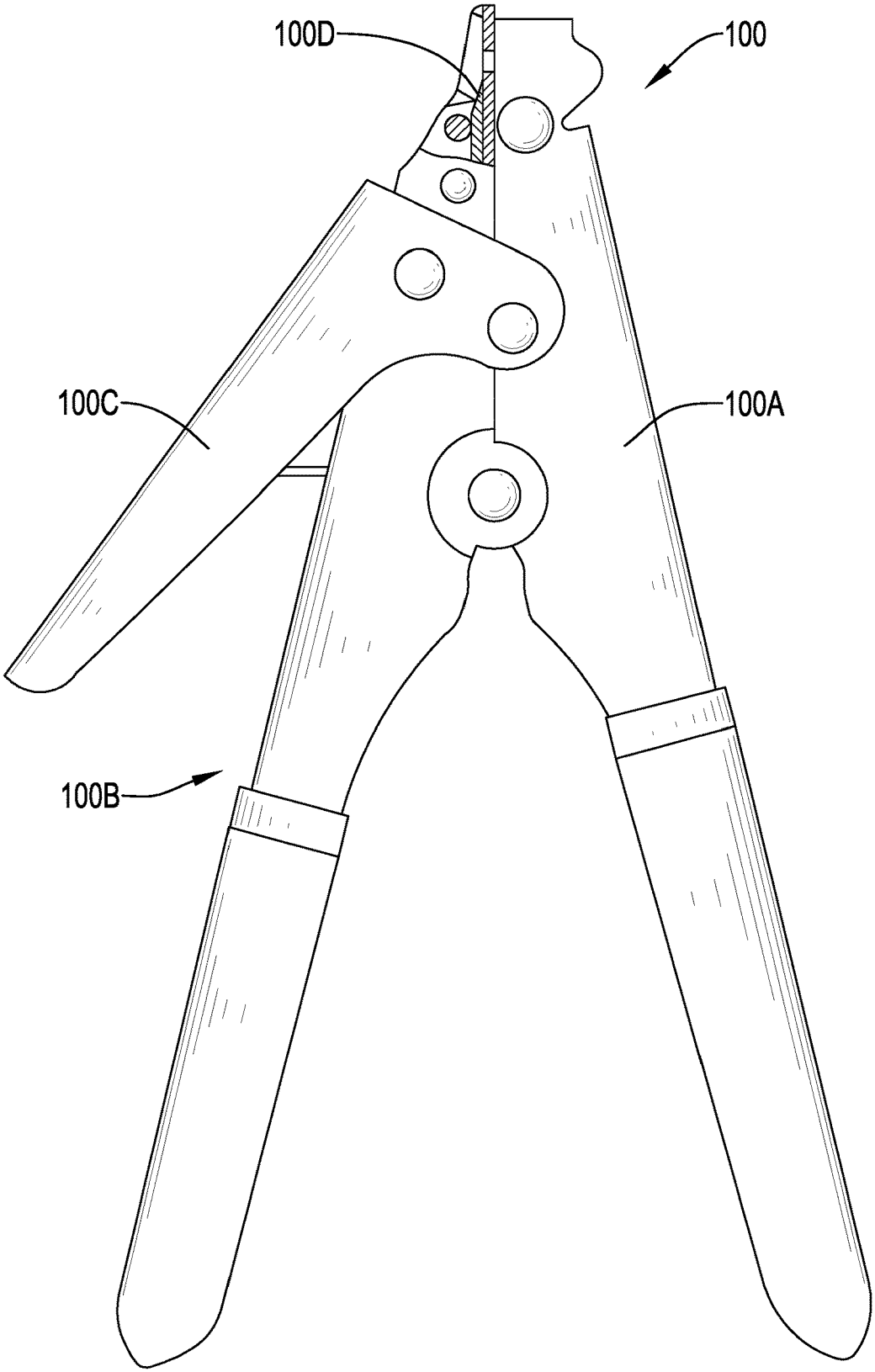
FIG.10 PRIOR ART
FIG. 10 is a side view in partial section of a conventional cable tie tool in accordance with the prior art.

With reference to FIGS. 8 and 9, when the cable tie 80 tightens up the multiple objects 90, the head 81 is blocked by the multiple objects 90 and is unable to be pushed by the second operating unit 20 anymore. When the user continuously presses the first operating unit 10 and the second operating unit 20, the first operating unit 10 subjects a force on the pivoting shaft 30. When a force applied by the user is larger than a pulling force applied by the extension spring 60, the pivoting shaft 30 pushes the activating element 51 and moves along the two guiding holes 23. When the pivoting shaft 30 moves through the curved sections 232 of the two guiding holes 23 and enters the second guiding sections 233 of the two guiding holes 23, the activating element 51 pushes the cutting element 52 via it's activating arm 512. The cable tie 80 is cut by the cutting edge 523 of the cutting element 52 accordingly. Since the length L1 is larger than the length L2, the pivoting shaft 30 and the cutting element 52 move a sufficient distance to cut the cable tie.

With reference to FIGS. 7 to 9, when the cable tie 80 is cut, the second operating unit 20 is no longer blocked by the head 81 and the multiple objects 90. Therefore, the extension spring 60 pulls the activating element 51 again, the blocking arm 513 of the activating element 51 pushes the pivoting shaft 30 once more, and the pivoting shaft 30 moves from the second guiding sections 232, via the two curve sections 232, and back to the first guiding sections 232 of the two guiding holes 23.

When the user needs to adjust the tension of the cable tie 80 that is wrapped on the multiple objects 90, the knob 73 of the adjusting assembly 70 can be adjusted by the user to facilitate the second adjusting element 72 of the adjusting assembly 70 to move toward or away from the first adjusting element 71 along the threaded portion 711 of the first adjusting element 71, and the extension spring 60 is elongated accordingly. With the first adjusting element 71 and the second adjusting element 72 approaching each other, the extension spring 60 elongates longer and exerts a larger force on the activating element 51, and the user needs to overcome the larger force to cut the cable tie 80. That is, the cable tie 80 is cut by the cutting element 52 after the multiple objects 90 are further tightened by the cable tie 80. On the contrary, with the first adjusting element 71 and the second adjusting element 72 moving away from each other, the force exerted on the activating element 51 by the extension spring 60 is getting smaller. The cable tie 80 is easy to be cut, and the multiple objects 90 are less tightened by the cable tie 80.

The user can observe the indicating plate 741 of the indicating element 74 via the observing hole 24 of the second operating unit 20. The user can know the force exerted by the extension spring 60 by reading the indicating marks 742 on the indicating plate 741.

Compared to the conventional cable tie tool 100, the cable tie tool of the present invention is free from being equipped with the third handle 100C to control the cutting element 100D of the conventional cable tie tool 100. The cable tie tool of the present invention has a simple structure and a neat outline. The user can directly manipulate the first operating unit 10 and the second operating unit 20 of the cable tie tool of the present invention to cut a cable tie 80 without manipulating the third handle 100C of the conventional cable tie tool. Therefore, the cable tie tool of the present invention is convenient for use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cable tie tool comprising:

a first operating unit having a clamping end and an operating end disposed opposite to each other;

a second operating unit having two guiding holes aligned with each other; and a cutting end and an adjusting end disposed opposite to each other;

a pivoting shaft mounted within the two guiding holes, pivotally connected with the first operating unit and the second operating unit, and being movable along the two guiding holes;

a torsion spring having two ends respectively abutting against and pushing the first operating unit and the second operating unit respectively such that the clamping end of the first operating unit abuts against the cutting end of the second operating unit;

a cutting assembly having an activating element pivotally connected to the second operating unit and abutting against the pivoting shaft; and a cutting element movably mounted in the second operating unit and having a cutting edge positioned toward the cutting end of the second operating unit, and the cutting element driven by the activating element to alternately move toward the cutting end and the adjusting end of the second operating unit; and an extension spring having a first end connected to the activating element; and a second end connected to the second operating unit;

wherein, the extension spring is stretched such that the activating element blocks the pivoting shaft from moving along the two guiding holes;

each one of the guiding holes is curved and has a first guiding section, a curved section, and a second guiding section sequentially arranged and communicating with one another;

the first guiding section of each one of the guiding holes has a first terminal end positioned toward the cutting end of the second operating unit and extends toward the adjusting end of the second operating unit;

the curved section of each one of the guiding holes extends toward the cutting end of the second operating unit;

the second guiding section of each one of the guiding holes has a second terminal end positioned toward the cutting end of the second operating unit in each one of the two guiding holes, a length of the first guiding section is shorter than a length of the second guiding section;

the second operating unit has a main body; and at least one restricting element connected to the main body of the second operating unit and being parallel to the pivoting shaft;

the cutting element has a blade restricted between the at least one restricting element and the main body of the second operating unit;

the activating element has a pivoting portion pivotally connected to the second operating unit;

an activating arm extending from the pivoting portion and having a terminal end and an engaging protrusion formed at the terminal end of the activating arm; and a blocking arm extending from the pivoting portion and having a recess for receiving the pivoting shaft; and the cutting element has an engaging hook, the engaging hook and the cutting edge are respectively disposed at two opposite ends of the blade, and the engaging hook hooks on the engaging protrusion of the activating arm.

2. The cable tie tool as claimed in claim 1, wherein the cable tie tool has an adjusting assembly and the adjusting assembly has a first adjusting element fixed to the second end of the extension spring;

a second adjusting element screwed with the first adjusting element; and a knob fixed to the second adjusting element and abutting against the adjusting end of the second operating unit.

3. The cable tie tool as claimed in claim 2, wherein
the second operating unit has an observing hole defined through the main body of the second operating unit;
the adjusting assembly has an indicating element connected between the second end of the extension spring and the first adjusting element and having
an indicating plate covering the observing hole; and
multiple indicating marks formed on the indicating plate and exposed in the observing hole.

4. The cable tie tool as claimed in claim 3, wherein
the second operating unit has a first blocking plate; and
the first adjusting element is blocked by the first blocking plate.

5. The cable tie tool as claimed in claim 4, wherein
the second operating unit has a second blocking plate disposed adjacent to the adjusting end of
the second operating unit; and
the second adjusting element is blocked by the second blocking plate.

* * * * *